US009373493B2

(12) United States Patent
Kou

(10) Patent No.: US 9,373,493 B2
(45) Date of Patent: Jun. 21, 2016

(54) MASS SPECTROMETER AND METHOD OF ADJUSTING SAME

(71) Applicant: JEOL Ltd., Tokyo (JP)

(72) Inventor: Junkei Kou, Tokyo (JP)

(73) Assignee: JEOL Ltd., Tokyo (JP)

( * ) Notice: Subject to any disclaimer, the term of this patent is extended or adjusted under 35 U.S.C. 154(b) by 24 days.

(21) Appl. No.: 14/084,931

(22) Filed: Nov. 20, 2013

(65) Prior Publication Data

US 2014/0138539 A1 May 22, 2014

(30) Foreign Application Priority Data

Nov. 20, 2012 (JP) ..... 2012-254576

(51) Int. Cl.
*H01J 49/42* (2006.01)

(52) U.S. Cl.
CPC ..... *H01J 49/427* (2013.01)

(58) Field of Classification Search
USPC ..... 250/281, 282, 283, 290, 293; 436/173
See application file for complete search history.

(56) References Cited

U.S. PATENT DOCUMENTS 5,572,025 A * 11/1996 Cotter et al. ..... 250/292
5,623,144 A * 4/1997 Yoshinari et al. ..... 250/281
7,015,461 B2 * 3/2006 Shiokawa et al. ..... 250/281
7,858,926 B1 * 12/2010 Whitehouse et al. ..... 250/281
2007/0176098 A1 * 8/2007 Wells ..... 250/292
2008/0217527 A1 * 9/2008 Wang ..... 250/282
2010/0237237 A1 * 9/2010 Green et al. ..... 250/283
2011/0147582 A1 * 6/2011 Makarov et al. ..... 250/282
2011/0204221 A1 * 8/2011 Satake et al. ..... 250/282
2012/0193526 A1 * 8/2012 Kovtoun ..... 250/282

FOREIGN PATENT DOCUMENTS

JP 2010127714 A 6/2010

* cited by examiner

*Primary Examiner* — Robert Kim
*Assistant Examiner* — Sean Luck
(74) *Attorney, Agent, or Firm* — The Webb Law Firm

(57) ABSTRACT

A mass spectrometer and method capable of optimizing the opening time of a collision cell includes: an ion source (10) for ionizing a sample; a first mass analyzer (30) for selecting first desired ions from the ions generated in the ion source (10); a collision cell (40) for fragmenting some or all of the first desired ions into product ions; a second mass analyzer (50) for selecting second desired ions from the first desired ions and the product ions; a detector (60) for detecting the second desired ions; and a control section (200) for controlling the collision cell (40) in such a way that the cell performs a storing operation for storing the first desired ions and the product ions for a given storage time and then performs an opening operation for ejecting the stored ions for a given opening time based on information about settings in an adjustment mode.

14 Claims, 10 Drawing Sheets

FIG. 4
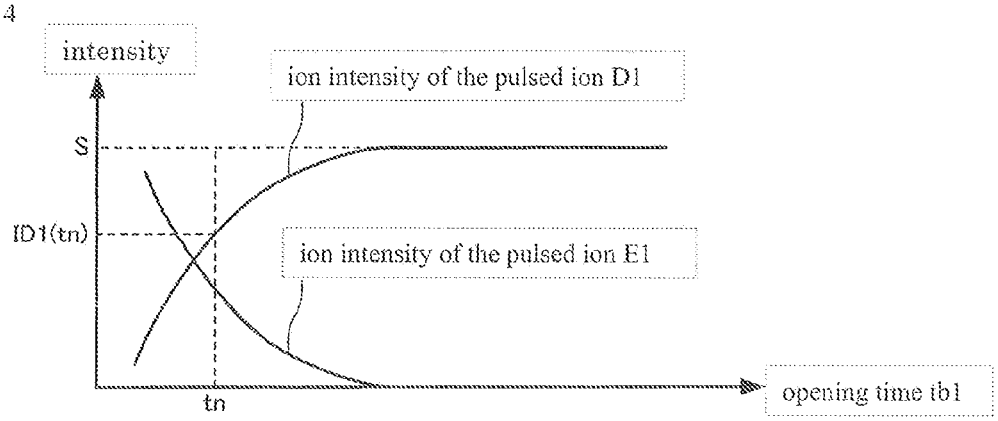
FIG. 5
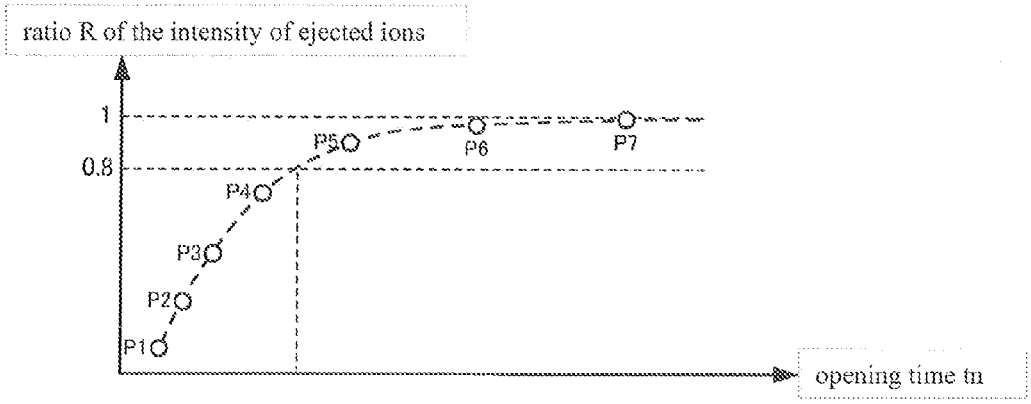
FIG. 6
| m/z of the ion selected by second mass analyzer | opening time of exit electrode of collision cell |
|---|---|
| m1 | t1 |
| m2 | t2 |
| m3 | t3 |
| ⋮ | |

MASS SPECTROMETER AND METHOD OF ADJUSTING SAME

BACKGROUND OF THE INVENTION

1. Field of the Invention

The present invention relates to a mass spectrometer and method of adjusting it.

2. Description of Related Art

A quadrupole mass spectrometer is an instrument which has a quadrupole mass filter generating a hyperbolic electric field and which operates to produce a selecting voltage by superimposing an RF voltage and a DC voltage on each other and to pass ions of only a desired mass-to-charge ratio by applying the selecting voltage and an axial voltage (that is a DC offset voltage applied to the four quadrupole electrodes equally). If only the RF voltage and axial voltage are applied to the quadrupole mass filter, this filter acts as an ion guide that passes all ions of a certain mass-to-charge ratio or higher. A triple quadrupole mass spectrometer is built by coupling two quadrupole mass filters and mounting a collision cell between them. Since the triple quadrupole mass spectrometer has two mass analyzers, this mass spectrometer provides higher ion selectivity than a single quadrupole mass spectrometer and thus is often used in quantitative and qualitative analysis.

In a triple quadrupole mass spectrometer, desired ions are first selected by the first mass analyzer. The ions selected by the first mass analyzer are normally known as precursor ions and guided into a collision cell including a multipole ion guide. An entrance electrode and an exit electrode are disposed on opposite sides of the ion guide. The ion guide has means (such as a needle valve) for introducing a gas from the outside. If a gas is introduced into the collision cell, precursor ions collide against the collision gas, producing fragmentation with a certain probability. As a result, the precursor ions are fragmented in the collision cell. These fragmented ions are known as product ions. Only intended ions of the precursor ions and the product ions in the collision cell are separated by the second mass analyzer and detected.

Sometimes, ion cooling is done on the upstream side of the first mass analyzer. In the cooling, ions are normally caused to collide with a gas by a multipole ion guide. The collision with the gas lowers the average kinetic energy of the ions and also reduces the range of kinetic energies. The cooling makes uniform the velocities of ions about to enter the first mass analyzer. This leads to improvements of resolution and sensitivity.

When quantitative analysis is performed, triple quadrupole mass spectrometers are often used in a mode known as multiple reaction monitoring (MRM). In this mode, ions of certain mass-to-charge ratios are selected by the first mass analyzer and the second mass analyzer, respectively. One measurement in which different ions are selected by the first and second mass analyzers is known as a transition. Transitions which are different in combination of selected ions are carried out in turn. Transitions performed in succession may interfere with each other. For example, if ions generated by a previous transition are left in the collision cell, and if the next transition is performed, then it is impossible to know which of the transitions produced the detected ions. In order to carry out multiple reaction monitoring (MRM) with reliable results, it is desired that ions in the collision cell be ejected as much as possible whenever the transition is varied.

JP-A-2010-127714 sets forth a method of accomplishing high sensitivity of the instrument by temporarily storing ions in a collision cell and then ejecting the ions. Since the ejected ions are pulsed, acceptance of noises is suppressed by accumulating pulsed portions as signals. In this way, the sensitivity of the instrument can be improved.

Even in this triple quadrupole mass spectrometer where ions are stored in the collision cell, it is important to eject ions from the collision cell as much as possible whenever the transition is varied. To reduce interference between transitions, the opening time in which ions are ejected should be increased. However, if the opening time of the collision cell is lengthened, high-speed multiple reaction monitoring can no longer be achieved. In this way, the opening time should not be too short or too long. The opening time needs to be optimized according to the tolerable range of interference between transitions.

SUMMARY OF THE INVENTION

In view of the foregoing problem, the present invention has been made. According to some aspects of the invention, it is possible to offer a mass spectrometer and mass spectrometer adjusting method capable of optimizing the time for which a collision cell is opened.

(1) A mass spectrometer associated with the present invention has: an ion source for ionizing a sample; a first mass analyzer for selecting first desired ions from the ions generated in the ion source according to mass-to-charge ratio; a collision cell for fragmenting some or all of the first desired ions into product ions; a second mass analyzer for selecting second desired ions from the first desired ions and the product ions according to mass-to-charge ratio; a detector for detecting the second desired ions; and a control section for controlling the collision cell in such a way that the cell performs a storing operation for storing the first desired ions and the product ions for a given storage time and then performs an opening operation for ejecting the stored ions for a given opening time. In an adjustment mode, the control section adjusts the opening time based on information about settings.

In this mass spectrometer associated with the present invention, the adjustment mode is introduced to adjust the opening time of the collision cell based on the information about the settings, whereby the opening time of the collision cell can be optimized.

(2) In one feature of this mass spectrometer, the collision cell has an entrance and an exit. The control section may cause the collision cell to perform the storing operation by opening the entrance of the cell and closing the exit of the cell. The control section may cause the collision cell to perform the opening operation by closing the entrance of the cell and opening the exit of the cell.

(3) In another feature of this mass spectrometer, the information about the settings may indicate a target value of the ratio of the amount of the second desired ions ejected from the collision cell by the opening operation to the amount of the second desired ions stored in the collision cell immediately prior to the opening operation.

In this mass spectrometer, the opening time can be optimized according to the tolerable range of interference between transitions by searching for and finding a value of the opening time that brings the ratio of the intensity of ions ejected from the collision cell closest to a target value.

(4) In a further feature of this mass spectrometer, in the adjustment mode, the control section may cause the collision cell to perform the opening operation plural times whenever the storing operation is performed once, measure the amount of the second desired ions ejected from the collision cell by the opening operation performed first in response to a detection signal from the detector while varying the opening time during the opening operation performed first after the storing operation and the amount of the second desired ions ejected from the collision cell by performing the opening operation plural times, and calculate a value of the opening time at which the ratio of these two measured amounts is closest to the target value.

According to this mass spectrometer, almost all of the ions stored in the collision cell can be ejected by performing the opening operation plural times whenever the collision cell performs the storing operation once. Therefore, the ratio of the intensity of ions ejected by the opening operation performed first after the storing operation can be calculated from the ratio of the total amount of ions ejected by performing the opening operation plural times to the amount of ions ejected by performing the opening operation for the first time after the storing operation.

(5) In a still other feature of this mass spectrometer, the information about the settings may indicate a target value of the amount of the second desired ions ejected from the collision cell by the opening operation.

According to this mass spectrometer, the opening time can be optimized according to the tolerable range of interference between transitions by searching for and finding a value of the opening time at which the intensity of ejected ions is closest to a target value.

(6) In a yet other feature of this mass spectrometer, in the adjustment mode, the control section may measure the amount of the second desired ions ejected from the collision cell by the opening operation in response to the detection signal from the detector while varying the opening time and calculate a value of the opening time at which the measured amount is closest to the target value.

According to this mass spectrometer associated with the present invention, the intensity of the ejected ions during the opening operation after the storing operation can be calculated from the amount of ions ejected by the opening operation performed for the first time after the storing operation of the collision cell.

(7) In an additional feature of this mass spectrometer, the control section may provide control to maintain the storage time constant.

According to this mass spectrometer associated with the present invention, the amount of ions stored in the collision cell can be kept constant by maintaining constant the storage time for the collision cell.

(8) In a still further feature of this mass spectrometer, the control section may provide control such that at least one of the first and second mass analyzers acts as an ion guide.

In this mass spectrometer associated with the present invention, ion intensities can be measured at high sensitivity by operating at least one of the first and second mass analyzers as an ion guide. This improves the accuracy at which the opening time of the collision cell is adjusted.

(9) In a yet additional feature of this mass spectrometer associated with the present invention, there is further provided a cooling chamber mounted between the ion source and the first mass analyzer to lower kinetic energies of the ions generated in the ion source. The control section may provide control such that the cooling chamber performs a storing operation for temporarily storing the ions generated in the ion source and then performs an opening operation for ejecting the stored ions.

In this mass spectrometer associated with the present invention, pulsed ions are generated in the cooling chamber. Consequently, ion intensities can be measured at high sensitivity. This improves the accuracy at which the opening time of the collision cell is adjusted.

(10) In a still additional feature of this mass spectrometer, the control section may cause the cooling chamber to perform the storing operation by keeping the entrance of the cooling chamber open and closing the exit of the cooling chamber and cause the cooling chamber to perform the opening operation by opening the exit of the cooling chamber.

(11) In another feature of this mass spectrometer, the control section may provide control such that the storing operation and the opening operation are carried out for given times by the cooling chamber.

In this mass spectrometer associated with the present invention, the amount of ions entering the collision cell can be maintained constant by maintaining constant the storage time and the opening time of the cooling chamber.

(12) In a further feature of this mass spectrometer, in the adjustment mode, the control section may calculate the opening time according to the information about the settings for each mass-to-charge ratio of the second desired ions, produce information indicating corresponding relationships between mass-to-charge ratios of the second desired ions and set values of the opening time based on the calculated opening times, and record the produced information.

(13) In a still additional feature of this mass spectrometer, in a measurement mode, the control section may set the opening time according to the mass-to-charge ratios of the selected second desired ions based on the information indicating the corresponding relationships.

In this mass spectrometer associated with the present invention, the opening time of the collision cell can be optimized for each transition even if an actual sample is measured by interpolating or extrapolating the relationship between the mass-to-charge ratio of the second desired ions and set values of the opening time.

(14) In a still further feature of this mass spectrometer, at least one of the first and second mass analyzers may include a quadrupole mass filter.

(15) An adjustment method associated with the present invention is implemented in a mass spectrometer which has: an ion source for ionizing a sample; a first mass analyzer for selecting first desired ions from the ions generated in the ion source according to mass-to-charge ratio; a collision cell for fragmenting some or all of the first desired ions into product ions; a second mass analyzer for selecting second desired ions from the first desired ions and the product ions according to mass-to-charge ratio; a detector for detecting the second desired ions; and a control section for controlling the collision cell in such a way that the cell performs a storing operation for storing the first desired ions and the product ions for a given storage time and then performs an opening operation for ejecting the stored ions for a given opening time. The method starts with measuring the amount of the second desired ions ejected from the collision cell by the opening operation while varying the opening time. This is herein referred to as the first measuring step. The amount of the second desired ions stored in the collision cell immediately prior to the opening operation of the first measuring step is measured. This is herein referred to as the second measuring step. During each opening time, an "ejected ion intensity ratio", which is defined to be the ratio of the amount measured by the first measuring step to the amount measured by the second measuring step, is calculated. A value of the opening time at which the ejected ion intensity ratio is closest to a target value is calculated based on the calculated ejected ion intensity ratio.

According to this mass spectrometer associated with the present invention, the opening time can be optimized according to the tolerable range of interference between transitions by searching for and finding a value of the opening time at which the ratio of the intensity of ions ejected from the collision cell is closest to a target value.

(16) Another adjustment method associated with the present invention is implemented in a mass spectrometer which has: an ion source for ionizing a sample; a first mass analyzer for selecting first desired ions from the ions generated in the ion source according to mass-to-charge ratio; a collision cell for fragmenting some or all of the first desired ions into product ions; a second mass analyzer for selecting second desired ions from the first desired ions and the product ions according to mass-to-charge ratio; a detector for detecting the second desired ions; and a control section for controlling the collision cell in such a way that the cell performs a storing operation for storing the first desired ions and the product ions for a given storage time and then performs an opening operation for ejecting the stored ions for a given opening time. The adjustment method starts with measuring the amount of the second desired ions ejected from the collision cell by the opening operation while varying the opening time. Then, a value of the opening time at which the amount of the second desired ions ejected from the collision cell by the opening operation is closest to a target value is calculated, based on the measured amount of the second desired ions.

This mass spectrometer adjusting method associated with the present invention makes it possible to optimize the opening time according to the tolerable range of interference between transitions by searching for and finding the value of the opening time at which the intensity of the ions ejected from the collision cell is closest to the target value.

BRIEF DESCRIPTION OF THE DRAWINGS

FIG. 4 is a graph showing the relationship between pulsed ion intensity and the opening time of the exit electrode of a collision cell included in the mass spectrometer shown in FIG. 1.

FIG. 5 is a graph showing the relationship between the opening time of the exit electrode of the collision cell and the ratio of the intensity of ejected ions.

FIG. 6 is a table illustrating the corresponding relationship between mass-to-charge ratio of ions selected by the second mass analyzer and the opening time of the exit electrode of the collision cell.

DESCRIPTION OF THE INVENTION

The preferred embodiments of the present invention are hereinafter described in detail with reference to the drawings. It is to be understood that the embodiments described below do not unduly restrict the scope of the present invention delineated by the appended claims and that the configurations described below are not always essential constituent elements of the invention.

1. First Embodiment (1) Configuration

The configuration of a mass spectrometer according to a first embodiment of the present invention is first described. This spectrometer is a so-called triple quadrupole mass spectrometer and shown in FIG. 1 that is a schematic cross section of the spectrometer, taken in the vertical direction.

Figure 1:
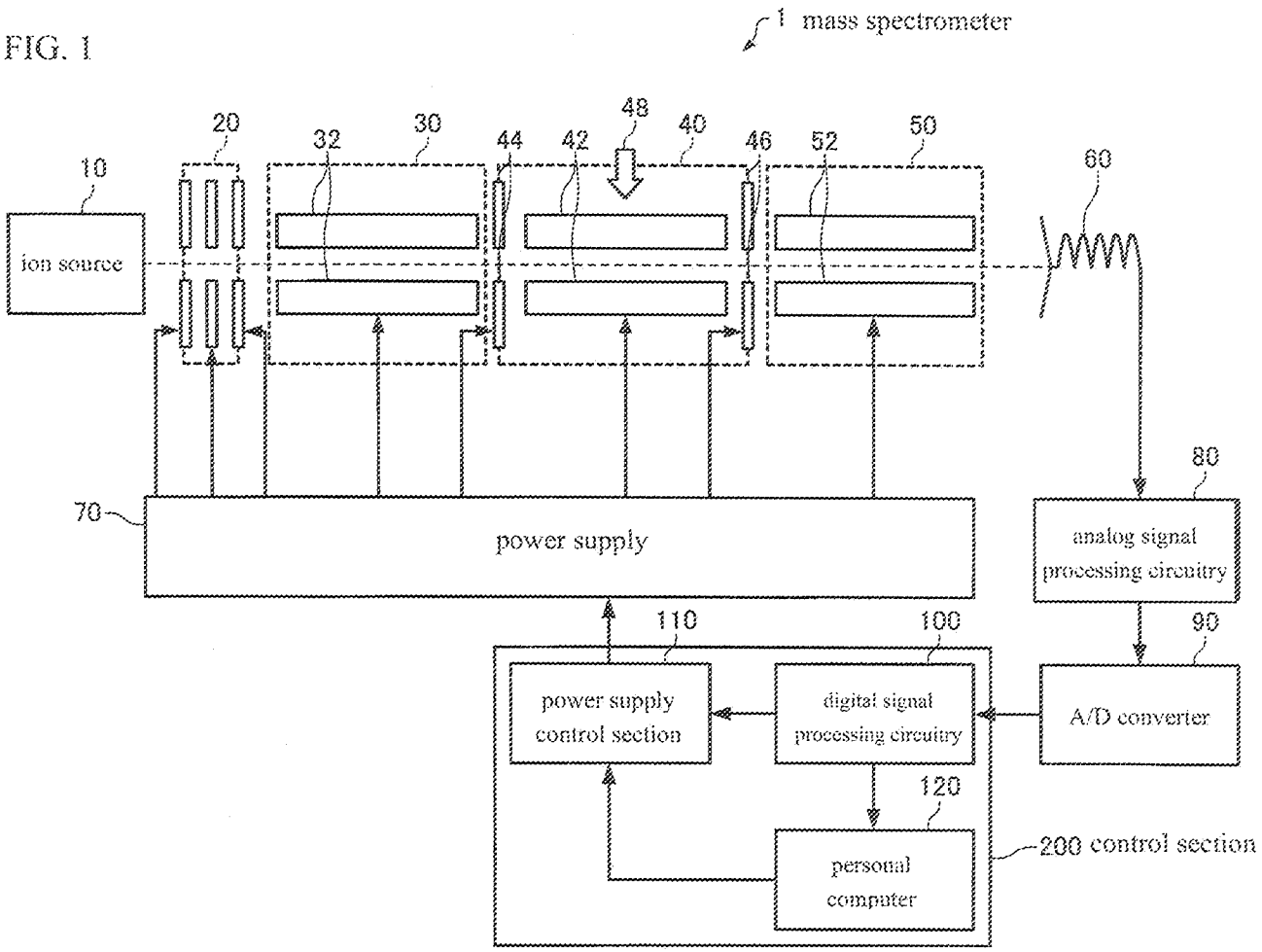
FIG. 1 is a block diagram of a mass spectrometer according to a first embodiment of the present invention.

Referring to FIG. 1, the mass spectrometer according to the first embodiment is generally indicated by reference numeral 1 and configured including an ion source 10, an ion extractor 20, a first mass analyzer 30, a collision cell 40, a second mass analyzer 50, a detector 60, a power supply 70, analog signal processing circuitry 80, an A/D converter 90, digital signal processing circuitry 100, a power supply control section 110, and a personal computer 120. Some of the constituent elements of the mass spectrometer shown in FIG. 1 may be omitted.

The ion source 10 ionizes a sample introduced from a sample inlet apparatus (not shown) such as a chromatograph by a given method. The ion source 10 can be a continuous atmospheric pressure ion source for continuously generating ions by an atmospheric pressure ionization method (such as an ESI) or an ion source utilizing an ionization method implemented in a vacuum such as an electron impact ionization method.

The ion extractor 20 consists of one or more electrodes, each centrally provided with an opening, and is mounted behind the ion source 10. The ions generated by the ion source 10 pass through the ion extractor 20 and enter the first mass analyzer 30.

The first mass analyzer 30 selects first desired ions from the ions generated in the ion source 10 according to mass-to-charge ratio m/z (the mass m of each ion divided by the valence number z). In particular, the first mass analyzer 30 is configured including a quadrupole mass filter 32. The first mass analyzer 30 passes only ions having a mass-to-charge ratio corresponding to a selecting voltage applied to the mass filter 32. The selecting voltage is obtained by superimposing an RF voltage and a DC voltage on each other. The ions selected by the first mass analyzer 30 are known as precursor ions.

The collision cell 40 is mounted behind the first mass analyzer 30. The precursor ions selected by the first mass analyzer 30 are guided into the collision cell 40. The collision cell 40 includes a multipole ion guide 42, as well as an entrance electrode 44 and an exit electrode 46 disposed at the opposite ends of the ion guide 42. Furthermore, the cell includes a gas inlet means 48 (such as a needle valve) for introducing a gas such as helium or argon from the outside. Each of the entrance electrode 44 and exit electrode 46 is centrally provided with an opening. By introducing a gas into the collision cell 40, some or all of the precursor ions collide with the gas and become fragmented with a certain probability provided that the collisional energies are equal to or higher than the dissociation energies of the precursor ions. The dissociation energies can be varied by the axial voltage on the multipole ion guide 42. Ions fragmented in the collision cell 40 are known as product ions.

The second mass analyzer 50 is mounted behind the collision cell 40. Precursor ions and product ions inside the collision cell 40 pass through the exit electrode 46 and enter the second mass analyzer 50, which selects second desired ions from the precursor ions and product ions according to mass-to-charge ratio (m/z). In particular, the second mass analyzer 50 is configured including a quadrupole mass filter 52. The second mass analyzer 50 selects and passes ions with a mass-to-charge ratio corresponding to the selecting voltage (superimposition of the RF voltage and DC voltage) applied to the quadrupole mass filter 52.

The detector 60 is mounted behind the second mass analyzer 50 such that the ions selected by the second mass analyzer 50 are detected by the detector 60. In particular, the detector 60 produces an output current proportional to the number of incident ions.

The output current from the detector 60 is converted into a voltage by the analog signal processing circuitry 80. Furthermore, the processing circuitry 80 may remove undesired noises by a filter.

The output signal from the analog signal processing circuitry 80 is sampled by the A/D converter 90 and converted into a digital signal.

This digital signal is accumulated a given number of times by the digital signal processing circuitry 100. The results are routed to the personal computer 120, which in turn stores the results in an ancillary storage device (not shown) and displays the results.

All the voltages applied to the ion source 10, ion extractor 20, first mass analyzer 30, collision cell 40, and second mass analyzer 50 are supplied from the power supply 70, which is under control of the power supply control section 110. Especially, in the present embodiment, the power supply control section 110 controls the power supply 70 such that the collision cell 40 performs a storing operation for a given storage time to store precursor ions and product ions and then performs an opening operation for a given opening time to eject the stored ions.

In the present embodiment, the digital signal processing circuitry 100, power supply control section 110, and personal computer 120 together constitute a control section 200. This control section 200 is placed either in an adjustment mode or in a measurement mode. In the adjustment mode, the control section 200 adjusts the opening time of the collision cell 40 according to information about settings (i.e., information about the ratio of the intensity of ions ejected from the collision cell 40). In the measurement mode, the control section 200 sets the opening time of the collision cell 40 according to the result of the adjustment made in the adjustment mode.

(2) Adjustment Method

Figure 2:
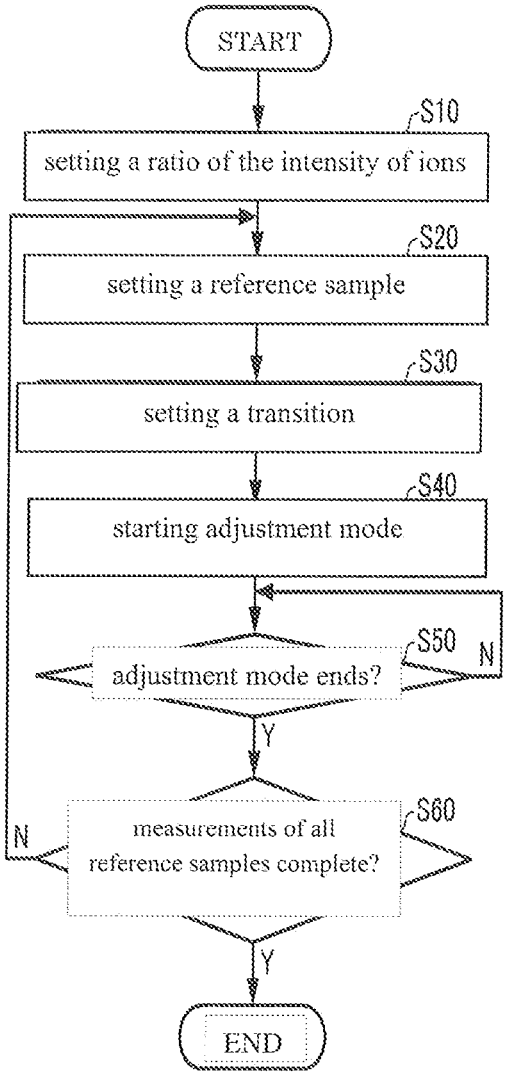
FIG. 2 is a flowchart illustrating one method of adjusting the mass spectrometer shown in FIG. 1.

A method of adjusting the mass spectrometer 1 of the first embodiment to adjust the opening time of the collision cell 40 employing the adjustment mode is next described. FIG. 2 is a flowchart illustrating one example of this method of adjusting the mass spectrometer 1.

As illustrated in FIG. 2, the user first sets a ratio of the intensity of ions (ratio of the amount of second desired ions ejected from the collision cell 40 by an opening operation to the amount of second desired ions stored in the collision cell 40 immediately prior to the opening operation) ejected from the collision cell 40 (step S10). More specifically, when the user enters information about the ratio of the intensity of ions ejected from the collision cell 40 through the personal computer 120, the entered information is stored in the storage device ancillary to the computer 120 or in other storage device.

Then, the user sets a reference sample in a reference sample inlet port (S20) and sets a transition, i.e., a combination of mass-to-charge ratios of ions selected respectively by the first mass analyzer 30 and second mass analyzer 50 (S30). In particular, if the user enters information about the transition by the use of the personal computer 120, the information is stored in the storage device ancillary to the computer 120 or in other storage device. Plural transitions can be set for one reference sample.

The user then starts the adjustment mode of the mass spectrometer 1 (S40). Specifically, if the user depresses the start button (software switch) for the adjustment mode, the start button being displayed on a display unit (not shown) ancillary to the personal computer 120, then the information about the transition is supplied to the power supply control section 110 together with the information about the depression. The adjustment mode is carried out while the power supply control section 110 varies the voltages on various portions in a given order.

When the adjustment mode ends (Yes at S50), if any reference sample to be measured is not yet measured (S60), the user sets a next reference sample not yet measured in the ion source 10 (S20). Steps S30 and S40 are repeated.

On the other hand, if the adjustment mode ends (Yes at S50), and if measurements of all reference samples to be measured are complete (Yes at S60), the adjusting subroutine for the mass spectrometer 1 ends. As a result, information about the corresponding relationship between the mass-to-charge ratio of ions selected by the second mass analyzer 50 and the optimum opening time of the exit electrode 46 of the collision cell 40 (i.e., an opening time closest to the ratio of the intensity of ejected ions set by the user) is obtained.

(3) Operation in Adjustment Mode

The operation of the mass spectrometer 1 according to the first embodiment in the adjustment mode is next described. In the following description, it is assumed that ions generated in the ion source 10 are positive ions. They may also be negative ions. An explanation similar to the explanation provided below can be applied to negative ions if the voltages are reversed in polarity.

A reference sample with known transitions is introduced in the ion source 10 continuously at a constant flow rate. The ions generated in the ion source 10 enter the first mass analyzer 30, where precursor ions of the mass-to-charge ratio indicated by the information about the settings on transitions are selected by the first mass analyzer 30. The selected ions enter the collision cell 40.

After ions are once stored in the collision cell 40, the ions are ejected from it. To permit ions to be stored and ejected, a pulsed voltage is applied to the exit electrode 46 from the power supply 70. If the pulsed voltage is made higher than the axial voltage on the multipole ion guide 42, the exit electrode 46 is closed. The ions are stored in the collision cell 40.

On the other hand, if the pulsed voltage is made lower than the axial voltage on the multipole ion guide 42, the exit electrode 46 is opened, permitting ejection of ions. A collision gas such as a rare gas is introduced into the collision cell 40 by the gas inlet means 48. The collision gas has the effect of cooling, in addition to the effect of promoting generation of product ions by fragmenting precursor ions. Therefore, ions returning to the entrance electrode 44 during storage after being bounced back by the potential barrier of the exit electrode 46 have energies lower than energies possessed by the ions which first passed through the entrance electrode 44. If the voltage on the entrance electrode 44 is adjusted, ions from the upstream side can be made to pass, while ions returning from the downstream side can be prevented from passing. Consequently, the storage efficiency of the collision cell 40 can be made high.

Storage of ions in the collision cell 40 and ejection from it allow for miniaturization of the mass spectrometer 1. In the mass spectrometer 1 that is a triple quadrupole mass spectrometer, if the first mass analyzer 30 or second mass analyzer 50 is shortened, the resolution will deteriorate. Therefore, shortening of the collision cell 40 is effective in achieving miniaturization. However, if the collision cell 40 is shortened, the number of collisions with the collision gas decreases, thus hindering fragmentation of the ions. If a large amount of collision gas is introduced in an attempt to secure a sufficiently large number of collisions, the pressures inside the first mass analyzer 30 and inside the second mass analyzer 50 increase. This may result in sensitivity deterioration. However, since ions are stored in the collision cell 40, the ions reciprocate between the entrance and exit of the cell 40. Therefore, if the collision cell 40 is shortened, it is possible to secure a number of collisions large enough to permit fragmentation while suppressing the amount of introduced gas.

In the adjustment mode of the present embodiment, pulsed ions are entered into the collision cell 40. For this purpose, a pulsed voltage is applied from the power supply 70 to any one of the ion extractor 20, first mass analyzer 30, and entrance electrode 44 which are on the upstream side of the multipole ion guide 42 to block the flow of ions temporarily. If the potential barrier created by the pulsed voltage is made higher than the total energy of the ions, the flow of ions is blocked. If the potential barrier is reduced, the ions are allowed to pass.

In the adjustment mode, if an instruction indicating a desired ratio of intensity of ions ejected from the collision cell 40 is given from the outside, the opening time is adjusted to achieve the desired ratio.

As described previously, the desired ratio of the intensity of ejected ions is entered into the personal computer 120 by the user. The computer 120 sends an instruction to the power supply control section 110, varying the opening time of the exit electrode 46. Ions having a mass-to-charge ratio indicated by the information about the settings on transitions are selected by the second mass analyzer 50 from the ions ejected from the collision cell 40 during this opening time, and are detected by the detector 60. The digital signal processing circuitry 100 computes the intensity of ions detected by the detector 60 and informs the personal computer 120 of the computed intensity. Based on the ion intensity, the personal computer 120 searches for and finds a value of the opening time at which the desired ratio of the intensity of ejected ions is achieved optimally.

Figure 3:
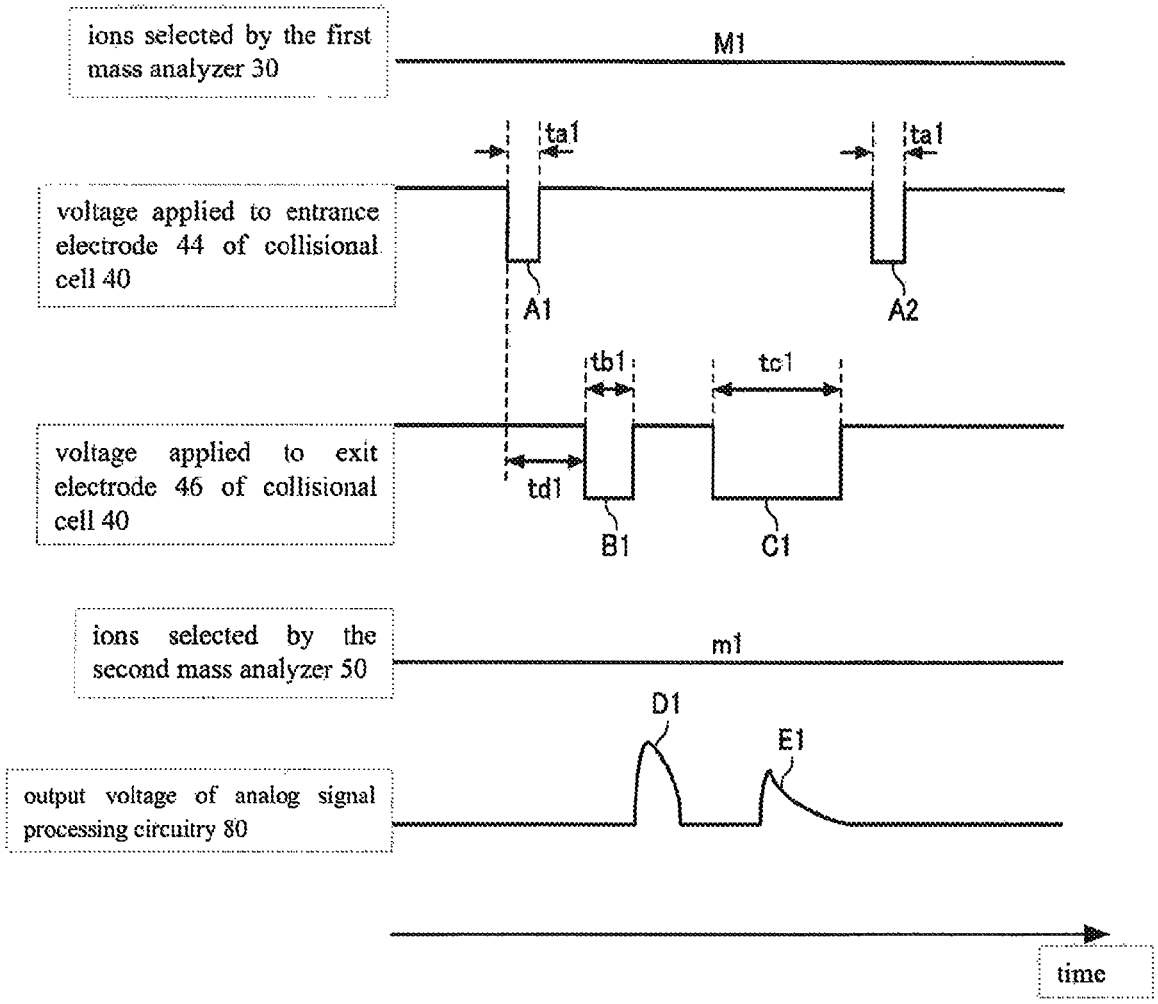
FIG. 3 is a timing chart illustrating operations performed in an adjustment mode of the mass spectrometer shown in FIG. 1.

FIG. 3 is a timing chart of voltages applied to the entrance electrode 44 and exit electrode 46 of the collision cell 40 in the adjustment mode. In FIG. 3, mass-to-charge ratios of ions selected by the first mass analyzer 30 and second mass analyzer 50 are M1 and m1, respectively.

As shown in FIG. 3, a pulsed voltage is applied to the entrance electrode 44 of the collision cell 40 to set the opening time to ta1. Ions are pulsed and passed into the collision cell 40. In FIG. 3, ions are pulsed at the entrance electrode 44 of the collision cell 40. Pulsing may be done anywhere as long as on the upstream side of the multipole ion guide 42.

Ions made to enter the collision cell 40 by the opening operation A1 of the entrance electrode 44 are fragmented in the collision cell 40. Then, the ions are ejected by the second opening operation of the exit electrode 46. The first opening operation B1 persists for time tb1. The second opening operation C1 persists for time tc1. After the end of the opening operation C1, the next opening operation A2 of the entrance electrode 44 permits ions to enter the collision cell 40.

Ions having a mass-to-charge ratio of m1 are selected by the second mass analyzer 50 out of pulsed ions ejected by the opening operations B1 and C1 of the exit electrode 46. The selected ions are output as pulsed ions D1 and E1, respectively, from the analog signal processing circuitry 80. The signals of the pulsed ions D1 and E1 are sampled by the A/D converter 90 and accumulated by the digital signal processing circuitry 100. Then, the resulting signal is routed to the personal computer 120.

The opening time tb1 of the exit electrode 46 of the collision cell 40 is variable. The opening time tc1 is constant and long enough to eject all the ions in the collision cell 40. If the opening time tb1 of the exit electrode 46 is sufficiently long, all the ions in the collision cell 40 are ejected by the opening operation B1. No ions are ejected by the opening operation C1. Conversely, if the opening time tb1 is short, not all the ions in the cell 40 are ejected by the opening operation B1. The remaining ions are ejected by the opening operation C1 and become the pulsed ion E1.

In the present embodiment, the total of the areas occupied by pulsed ion D1 and pulsed ion E1 is set equal to the total amount of ions having the mass-to-charge ratio of m1 and present in the collision cell 40 prior to execution of the opening operation B1. For this purpose, all the ions in the collision cell 40 are ejected by the opening operations B1 and C1. That is, the opening time tc1 is constant and long enough to eject all the ions in the cell 40.

The ion intensities of the pulsed ions D1 and E1 and the opening time tb1 of the exit electrode 46 have a relationship as shown in FIG. 4. If the opening time tb1 becomes longer, the ion intensity of the pulsed ion D1 increases and becomes saturated at a certain value S. The ion intensity of the pulsed ion E1 decreases to 0. The time in which the pulsed ion D1 becomes saturated is equal to the opening time tb1 in which the ion intensity of the pulsed ion E1 decreases down to 0.

The ion intensity S at which the saturation occurs arises from an amount of ions fragmented into ions having the mass-to-charge ratio m1 in the collision cell 40 out of the ions contained in the individual pulsed ions produced by the entrance electrode 44 of the collision cell 40. To make constant the ion intensity S, the amount of ions entering the collision cell 40 is made constant. Also, the efficiency at which precursor ions are fragmented into ions having the mass-to-charge ratio of m1 in the collision cell 40 is made constant. Since the amount of ions entering the collision cell 40 is in proportion to the opening time ta1 of the entrance electrode 44, this opening time ta1 is made constant. In order to make constant the fragmentation efficiency, the flow rate of gas introduced into the collision cell 40 is made constant. Furthermore, the time td1 from the instant when the opening operation A1 of the entrance electrode 44 starts to the instant when the opening operation B1 of the exit electrode 46 starts is made constant. Even when the opening time tb1 of the exit electrode 46 is varied, the time td1 is preferably kept constant.

As given by Eq. (1), the ratio R(tn) of the intensity of ejected ions at an arbitrary opening time tn of the opening operation B1 of the exit electrode 46 of the collision cell 40 is the ratio of the ion intensity ID1(*tn*) of the pulsed ion D1 when the opening time tn passes to the ion intensity S at which saturation occurs.

$$R(tn) = \frac{ID1(tn)}{S} \tag{1}$$

The personal computer 120 calculates the ratio R (tn) of the intensity of ejected ions for various values of the opening time tn using Eq. (1) and finds a value of the opening time at which the desired ratio of intensity of ions set by the user is achieved optimally. FIG. 5 is a graph showing one example of the relationship between the opening time tn and the ratio R (tn) of the intensity of ejected ions. In the example of FIG. 5, seven data points P1 to P7 indicated by white circles are obtained. For example, where the ratio of the intensity of ejected ions is set to 0.8, an optimum opening time for the ratio of the intensity of ejected ions of 0.8 can be computed by performing a linear interpolation between the data points P4 and P5 or approximating the relationship between the opening time tn and the ratio R (tn) of the intensity of ejected ions by a given polynomial equation and determining the values of the coefficients of the polynomial equation using the data points P1-P7 and a least squares approximation method.

Generally, an ion having a larger mass-to-charge ratio is ejected from the collision cell 40 in a longer time. Accordingly, ideally, the opening time of the exit electrode 46 of the collision cell 40 used when actual samples are measured in the measurement mode (described later) are optimized for the mass-to-charge ratios mn of ions selected by the second mass analyzer 50. For this purpose, a data table showing the optimum opening time of the exit electrode 46 for each mass-to-charge ratio nm as shown in FIG. 6 is needed. That is, information indicating the corresponding relationship between the mass-to-charge ratio of the ion selected by the second mass analyzer 50 and the optimum opening time of the exit electrode 46 is needed. For example, this table can be created by optimizing the opening time of the exit electrode 46 for the ions having plural mass-to-charge ratios selected by the second mass analyzer 50 in the adjustment mode and interpolating or extrapolating the results. The table may be generated by and stored in the personal computer 120. During measurements of actual samples, the table may be referred to according to the need.

Instead of the personal computer 120, the digital signal processing circuitry 100 may search for and find an opening time giving the desired ratio of the intensity of ejected ions optimally and construct and store a data table.

Figure 7:
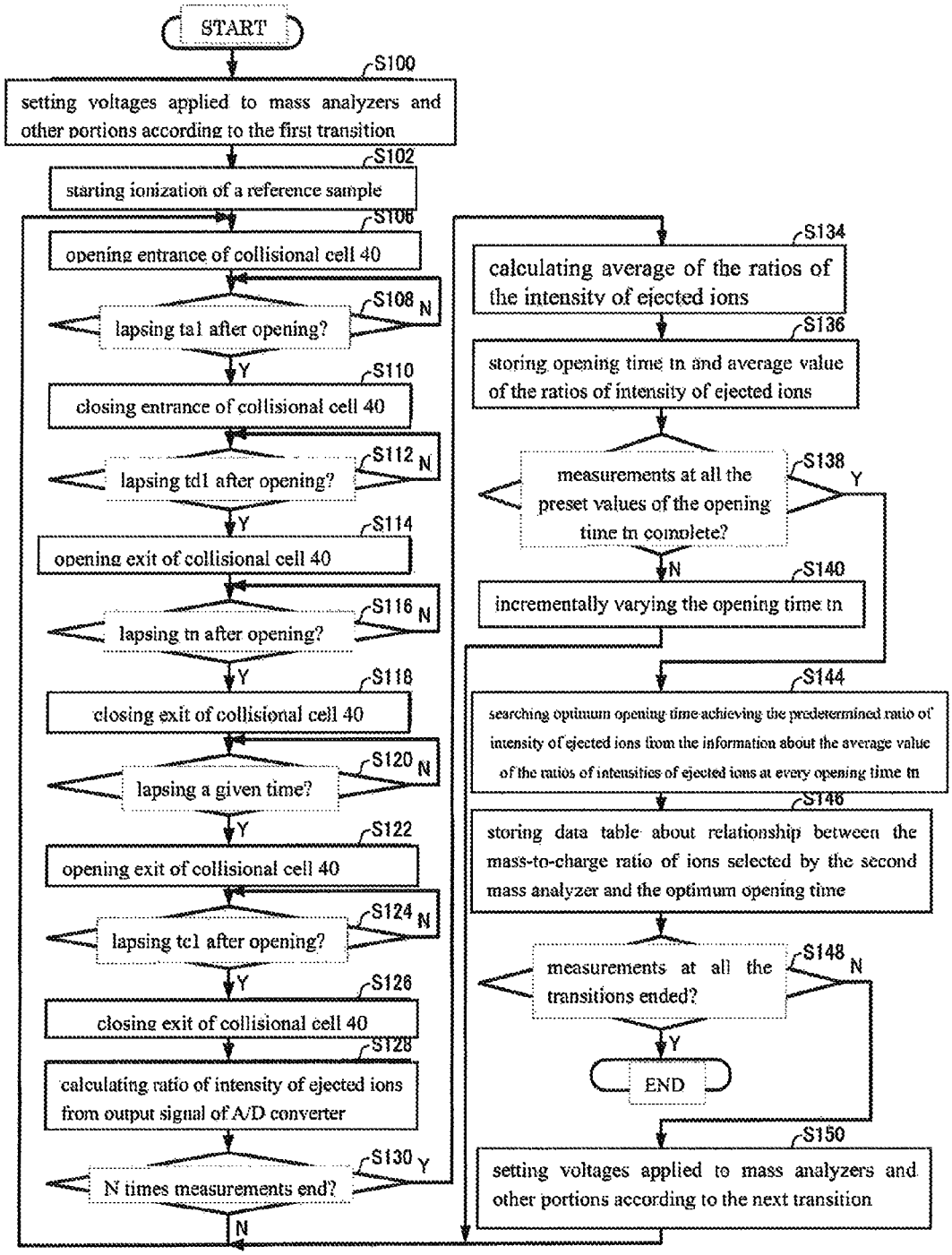
FIG. 7 is a flowchart illustrating one subroutine performed by a control section included in the mass spectrometer shown in FIG. 1 in an adjustment mode.

FIG. 7 is a flowchart illustrating one example of processing performed by the control section 200 in the adjustment mode for achieving the operations described so far.

As illustrated in FIG. 7, the control section 200 (especially, the power supply control section 110) sets the voltages applied to the first mass analyzer 30, second mass analyzer 50, and other portions, respectively, according to the first one of transitions set by the user in step S30 of FIG. 2 (S100).

The control section 200 then starts ionization of a reference sample set by the user in step S20 of FIG. 2 (S102).

The control section 200 (especially, the power supply control section 110) then varies the voltage on the entrance electrode 44 to open the entrance of the collision cell 40 (S106).

The control section 200 (especially, the power supply control section 110) then varies the voltage on the entrance electrode 44 to close the entrance of the collision cell 40 after a lapse of time of ta1 after opening of the entrance of the collision cell 40 (Yes at S108) (S110).

The control section 200 (especially, the power supply control section 110) then varies the voltage on the exit electrode 46 to open the exit of the collision cell 40 after a lapse of time td1 after opening of the entrance of the collision cell 40 (Yes at S112) (S114).

The control section 200 (especially, the power supply control section 110) then varies the voltage on the exit electrode 46 to close the exit of the collision cell 40 after a lapse of time to after opening of the exit of the collision cell 40 (Yes at S116) (S118).

The control section 200 (especially, the power supply control section 110) then varies the voltage on the exit electrode 46 to open the exit of the collision cell 40 after a lapse of a given time (Yes at S120) (S122).

The control section 200 (especially, the power supply control section 110) then varies the voltage on the exit electrode 46 to close the exit of the collision cell 40 after a lapse of time tc1 after opening of the exit of the collision cell 40 (Yes at S124) (S126).

The control section 200 (especially, the digital signal processing circuitry 100) then calculates the ratio of the intensity of ejected ions from the output signal (pulses D1 and E1 of FIG. 3) from the A/D converter 90 at a given timing (S128).

The control section 200 repeats the steps S106-S128 until a predetermined number, N (e.g., 10), of measurements end (No at S130).

If the N measurements end (Yes at S130), the control section 200 (especially, the digital signal processing circuitry 100) calculates the average of the ratios of the intensity of ejected ions derived by the N measurements (S134).

The control section 200 (especially, the personal computer 120) or the digital signal processing circuitry 100 then stores the opening time tn and the average value of the ratios of intensity of ejected ions (i.e., the result of the calculation of step S134) such that they are interrelated (S136).

The control section 200 incrementally varies the opening time tn (S140) (i.e., varies the opening time to its next set value) if measurements at all the preset values of the opening time tn (No at S138) are not complete, and repeats the steps S106-S136.

If measurements at all the predetermined set values of the opening time tn end (Yes at S138), the control section 200 (especially, the digital signal processing circuitry 100) then calculates the average value of the ratios of the intensities of ejected ions over the N measurements (S134).

Then, the control section 200 (especially, the personal computer 120) or the digital signal processing circuitry 100 searches for and finds an optimum opening time achieving the predetermined ratio of intensity of ejected ions from the information about the average value (stored at step S136) of the ratios of intensities of ejected ions at various values of the opening time tn (S144).

Then, the control section 200 (especially, the personal computer 120) or the digital signal processing circuitry 100 stores information (data table) about the corresponding relationship between the mass-to-charge ratio of ions selected by the second mass analyzer 50 (i.e., the results of the search made at step S144) and the optimum opening time (S146).

The control section 200 ends the processing performed in the adjustment mode if measurements at all the transitions set by the user at step S30 of FIG. 2 have ended (Yes at S148).

On the other hand, if measurements at all the transitions are not complete (No at S148), the control section 200 sets the voltages on the first mass analyzer 30, second mass analyzer 50, and other portions according to the next transition (S150) and repeats the steps S106-S146.

(4) Operation in Measurement Mode

The operation of the mass spectrometer 1 according to the first embodiment in the measurement mode is next described. In the following description, it is assumed that ions generated in the ion source 10 are positive ions. The ions may also be negative ions. An explanation similar to the explanation provided below can also be applied to negative ions if the voltages are reversed in polarity.

Figure 8:
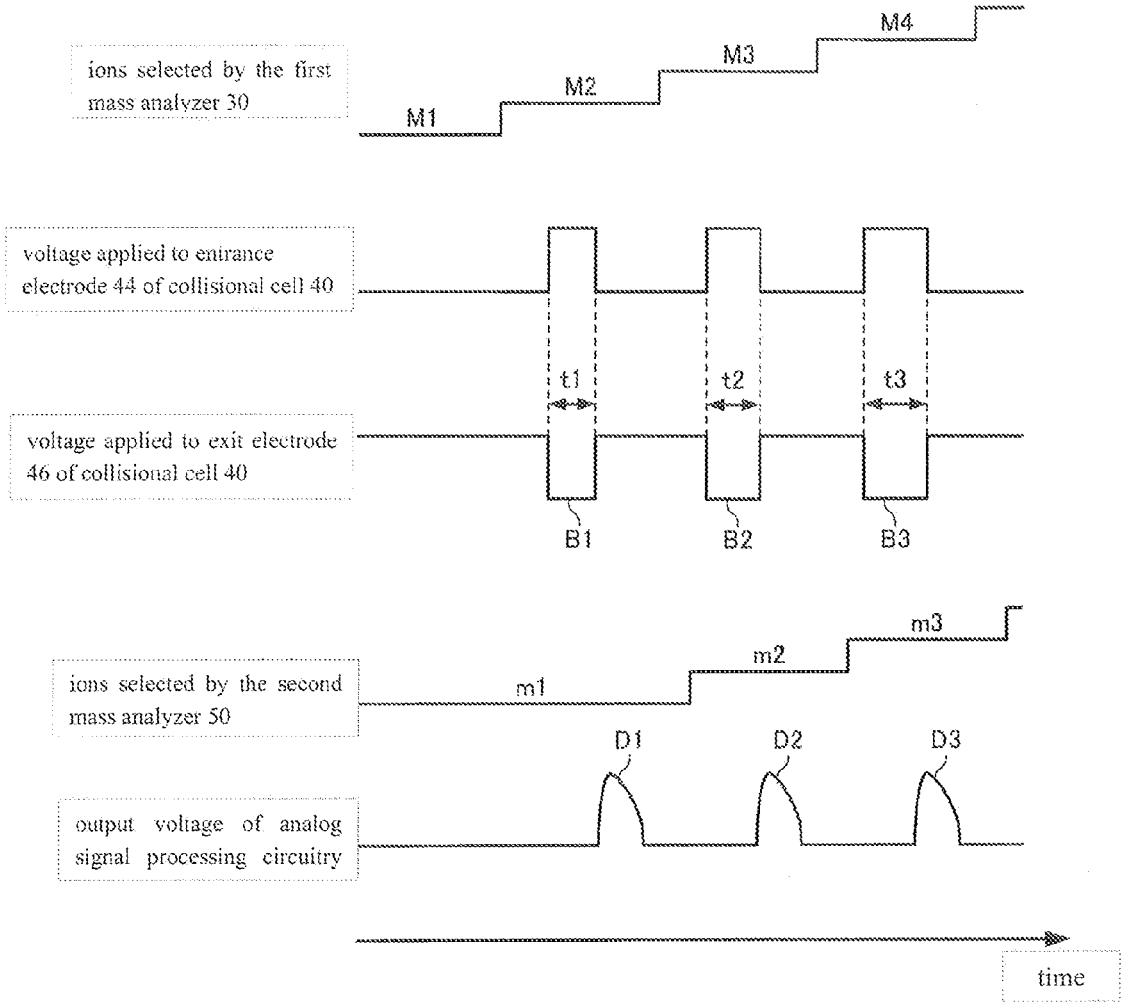
FIG. 8 is a timing chart illustrating operations of the mass spectrometer shown in FIG. 1 in a measurement mode.

FIG. 8 is a timing chart of the voltages applied to the entrance electrode 44 and exit electrode 46 of the collision cell 40 in the measurement mode.

As shown in FIG. 8, the mass-to-charge ratio of ions selected by the first mass analyzer 30 is first set to M1.

Ions having a mass-to-charge ratio of M1 and entering the collision cell 40 fragment in the cell 40 and then are ejected by the opening operation B1 of the exit electrode 46. The time t1 of the opening operation B1 is so set that the ratio of the intensity of ejected ions having a mass-to-charge ratio of m1 selected by the second mass analyzer 50 becomes equal to the ratio of the intensity of ejected ions set in the adjustment mode by the use of the table created and stored in the adjustment mode, the table indicating information about the corresponding relationship between the mass-to-charge ratio of ions selected by the second mass analyzer 50 and the optimum opening time of the exit electrode 46. During the opening operation B1, the entrance electrode 44 is closed to prevent ions from entering the collision cell 40.

Ions having the mass-to-charge ratio of m1 are selected by the second mass analyzer 50 from the pulsed ions ejected by the opening operation B1 of the exit electrode 46. As a result, the pulsed ion D1 is output from the analog signal processing circuitry 80. The signal indicative of the pulsed ion D1 is sampled by the A/D converter 90 and processed by the digital signal processing circuitry 100. The resulting signal is routed to the personal computer 120.

The mass-to-charge ratio of ions selected by the first mass analyzer 30 is varied to M2, for example. During the opening operation B2, the entrance electrode 44 is closed to prevent ions from entering the collision cell 40.

After ions having the mass-to-charge ratio of M2 and entering the collision cell 40 fragment in the cell 40, they are ejected by the opening operation B2 of the exit electrode 46. The time t2 of the opening operation B2 is so set that the ratio of intensity of ejected ions having the mass-to-charge ratio m2 and selected by the second mass analyzer 50 becomes equal to the ratio of intensity of ejected ions set in the adjustment mode using the table created and stored in the adjustment mode.

Ions having the mass-to-charge ratio of m2 are selected by the second mass analyzer 50 from the pulsed ions ejected by the opening operation B2 of the exit electrode 46. As a result, the analog signal processing circuitry 80 produces the pulsed ion D2. A signal indicative of the pulsed ion D2 is sampled by the A/D converter 90 and processed by the digital signal processing circuitry 100. The resulting signal is routed to the personal computer 120.

The mass-to-charge ratio of ions selected by the first mass analyzer 30 is then varied to M3, for example.

Ions having the mass-to-charge ratio M3 and entering the collision cell 40 fragment in the cell 40 and then are ejected by the opening operation B3 of the exit electrode 46. The time t3 of the opening operation B3 is so set that the ratio of the intensity of ejected ions having the mass-to-charge ratio m3 selected by the second mass analyzer 50 equals the ratio of intensity of ejected ions set in the adjustment mode, using the table created and stored in the adjustment mode. During the opening operation B3, the entrance electrode 44 is closed to prevent ions from entering the collision cell 40.

Ions having the mass-to-charge ratio m3 are selected by the second mass analyzer 50 from the pulsed ions ejected by the opening operation B3 of the exit electrode 46. As a result, the pulsed ion D3 is output from the analog signal processing circuitry 80. A signal indicative of the pulsed ion D3 is sampled by the A/D converter 90 and processed by the digital signal processing circuitry 100. The resulting signal is routed to the personal computer 120.

In this way, in the measurement mode, whenever the transition is varied, the opening time of the exit electrode 46 of the collision cell 40 is automatically set to an optimum value such that the ratio of the intensity of ejected ions selected by the second mass analyzer 50 assumes a desired value, using the table previously drawn up in the adjustment mode.

The mass spectrometer according to the first embodiment described so far searches for and finds a value of the opening time of the exit electrode 46 of the collision cell 40 at which the ratio of the intensity of ejected ions set in the adjustment mode is achieved optimally. Consequently, the opening time of the exit electrode 46 is optimized in the measurement mode. As a consequence, the fastest multiple reaction monitoring (MRM) within the tolerable range of interference between transitions permitted by the user or operator is enabled.

Furthermore, in the mass spectrometer of the present embodiment, a data table indicating the relation of the optimum opening time of the exit electrode 46 of the collision cell 40 to the mass-to-charge ratios of ions selected by the second mass analyzer 50 is created in the adjustment mode. Therefore, when actual samples are measured in the measurement mode, the opening time of the exit electrode 46 can be optimized for each transition.

In the present embodiment, the voltage applied to the exit electrode 46 of the collision cell 40 and the voltage for pulsing ions ahead of the collision cell 40 are pulsed voltages. These voltages can be in any form of controlled voltage as long as they temporarily cut off the flow of the ions and permit the flow only in a predetermined time.

The desired ratio of the intensity of ejected ions may be entered by the user or operator based on the tolerable range of interference between transitions. Alternatively, the desired ratio may be previously stored in the memory of the personal computer 120.

2. Second Embodiment

(1) Configuration

The configuration of a mass spectrometer according to a second embodiment is described. This mass spectrometer is a so-called triple quadrupole mass spectrometer. One example of the configuration of this instrument is shown in FIG. 9, which is a schematic cross section of the mass spectrometer of the present embodiment, taken in the vertical direction.

Figure 9:
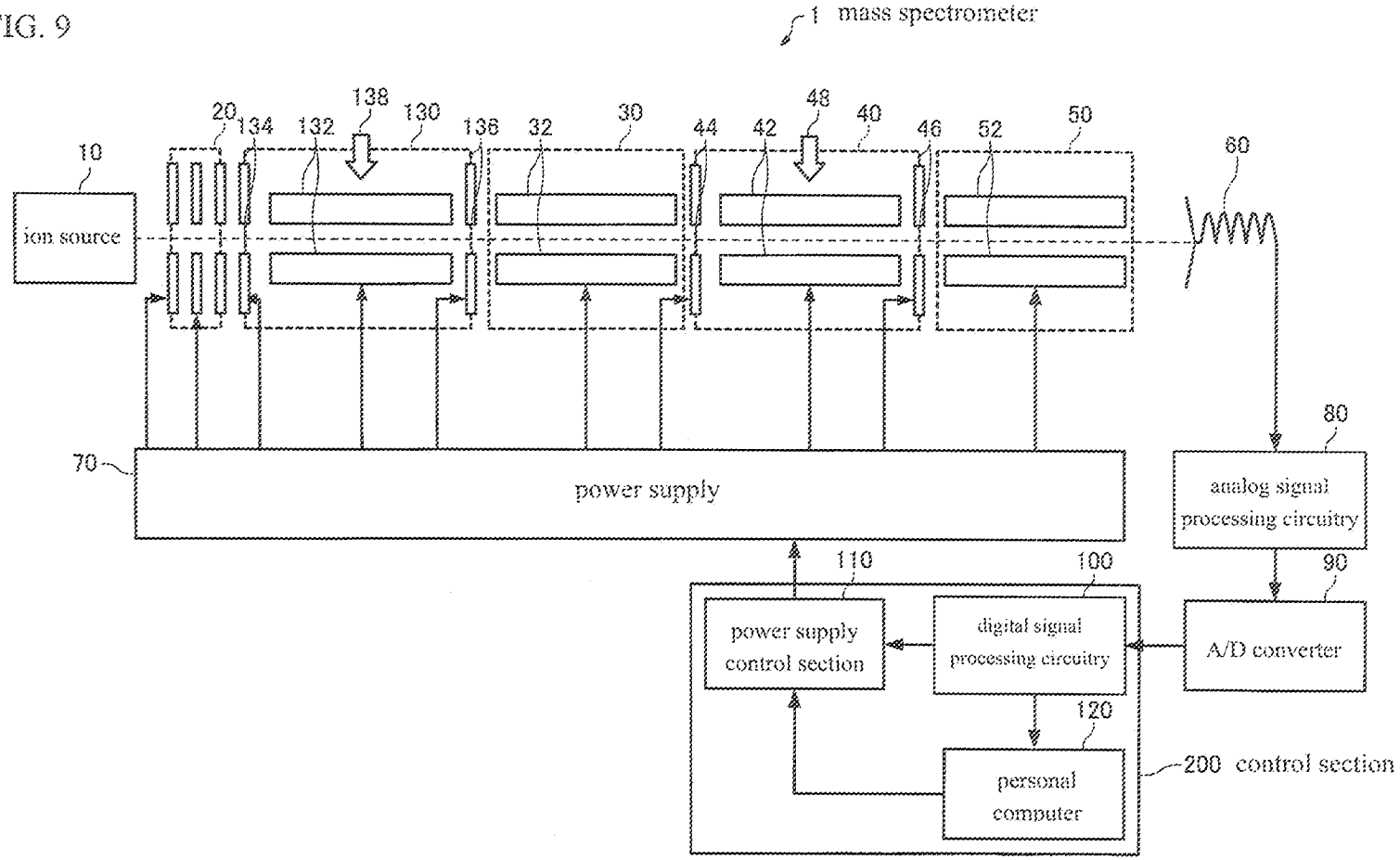
FIG. 9 is a block diagram of a mass spectrometer according to a second embodiment of the invention.

As shown in FIG. 9, the mass spectrometer according to the second embodiment is generally indicated by reference numeral 1 and configured including an ion source 10, an ion extractor 20, a cooling chamber 130, a first mass analyzer 30, a collision cell 40, a second mass analyzer 50, a detector 60, a power supply 70, analog signal processing circuitry 80, an A/D converter 90, digital signal processing circuitry 100, a power supply control section 110, and a personal computer 120. Some of the constituent elements of the mass spectrometer shown in FIG. 9 may be omitted. Those constituent elements shown in FIG. 9 which are similar to their counterparts of FIG. 1 are indicated by the same reference numerals as in FIG. 1 and a description thereof is omitted or simplified.

The difference of the mass spectrometer 1 according to the second embodiment with the mass spectrometer according to the first embodiment is that the cooling chamber 130 is mounted between the ion extractor 20 and the first mass analyzer 30. The cooling chamber 130 consists of an ion guide 132, as well as an entrance electrode 134 and an exit electrode 136 located at the opposite ends of the guide 132. Gas inlet means 138 such as a needle valve for introducing a gas from the outside may be installed in the cooling chamber 130 according to the need.

In other respects, the second embodiment is similar to the first embodiment and so a description thereof is omitted.

(2) Adjustment Method

The method of adjusting the mass spectrometer 1 according to the second embodiment consists of adjusting the opening time of the collision cell 40 using the adjustment mode and is similar to the method of the first embodiment. The method can be implemented by processing similar to the processing illustrated in FIG. 2 and so its illustration and description is omitted.

(3) Operation in Adjustment Mode

The operation of the mass spectrometer 1 according to the second embodiment in the adjustment mode is next described. In the following description, it is assumed that ions generated in the ion source 10 are positive ions. The ions may also be negative ions. An explanation provided below can also be applied to negative ions if the voltages are reversed in polarity. In the following description, regarding the contents which are common with the first embodiment, a description thereof is omitted.

Ions generated in the ion source 10 pass through the ion extractor 20 and enter the cooling chamber 130. Almost all the ions passed through the ion extractor 20 can be introduced into the cooling chamber 130 by keeping open the entrance electrode 134 of the cooling chamber 130.

In the cooling chamber 130, the entered ions are cooled, and storage and ejection of ions are repeated. Since ions repeatedly collide against the collision gas inside the cooling chamber 130, the cooling progresses. Where an atmospheric pressure ion source is used as the ion source 10, air flows in from the entrance electrode 134 together with the ions. Therefore, collision with the remaining gas cools the ions. Where the ion source 10 employs an ionization method implemented in a vacuum such as an electron impact ionization method, the remaining gas hardly flows in the cooling chamber 130 and, therefore, the gas introduction means 138 introduces the collision gas, thus promoting cooling of the ions. The final energy of the cooled ions decreases down to an energy level that is nearly equal to the positional energy produced by the axial voltage on the ion guide 132.

To permit the ions to be stored in and ejected from the cooling chamber 130, the exit electrode 136 is switched from a closed state to an open state and vice versa by a pulsed voltage. If the pulsed voltage is made higher than the axial voltage on the ion guide 132, the exit electrode 136 is closed. Ions are stored in the cooling chamber 130. On the other hand, if the pulsed voltage is made lower than the axial voltage on the ion guide 132, the exit electrode 136 is opened, thus ejecting the ions. The cooling makes lower the energy of ions returning to the entrance electrode 134 after being bounced back by the potential barrier of the exit electrode 136 during storage than the energy of the ions which first passed through the entrance electrode 134. Ions from the upstream side can be made to pass and ions returning from the downstream side can be blocked by adjusting the voltage on the entrance electrode 134. Consequently, the cooling chamber 130 can provide high storage efficiency.

The cooling chamber 130 produces only cooling without fragmenting ions. To inhibit fragmentation, the collisional energy is made lower than the dissociation energy of ions. No fragmentation occurs if the axial voltage on the ion guide 132 is so adjusted that the difference between the total energy of ions just passed through the entrance electrode 134 and the positional energy produced by the axial voltage on the ion guide 132 is smaller than the dissociation energy.

Operations performed in the adjustment mode of the second embodiment are similar to operations performed in the first embodiment except that the entrance electrode 44 of the collision cell 40 for pulsing the ions is replaced by the exit electrode 136 of the cooling chamber 130 and that the entrance electrode 44 of the collision cell 40 is kept open. To maintain constant the amount of ions entering the collision cell 40, the opening time and closing time of the exit electrode 136 of the cooling chamber 130 are kept constant.

Figure 10:
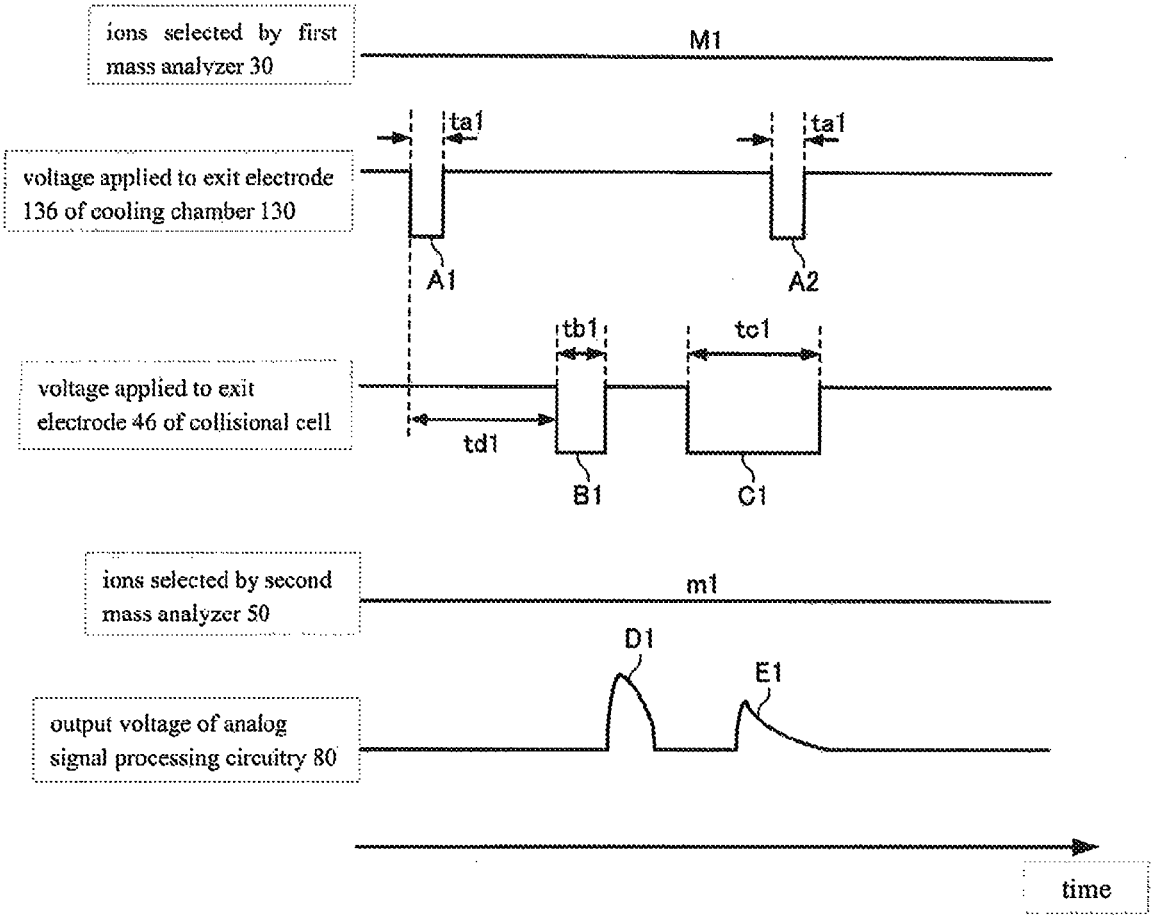
FIG. 10 is a timing chart illustrating operations of the mass spectrometer shown in FIG. 9 in an adjustment mode.

FIG. 10 is a timing chart illustrating voltages applied to the exit electrode 136 of the cooling chamber 130 and on the exit electrode 46 of the collision cell 40 in the adjustment mode. In FIG. 10, mass-to-charge ratios of ions selected by the first mass analyzer 30 and second mass analyzer 50 are M1 and m1, respectively.

Referring still to FIG. 10, a pulsed voltage giving an opening time of ta1 is applied to the exit electrode 136 of the cooling chamber 130. Ions are pulsed and pass through the first mass analyzer 30. The ions selected by the first mass analyzer 30 are guided into the collision cell 40.

Ions entering the collision cell 40 after made to pass through the first mass analyzer 30 by the opening operation A1 of the exit electrode 136 fragment in the collision cell 40 and then are ejected by the second opening operation of the exit electrode 46. The first opening operation B1 persists for a time period of tb1. The second opening operation C1 persists for a time period of tc1. After the end of the opening operation C1, the ions are allowed to pass through the first mass analyzer 30 by the next opening operation A2 of the exit electrode 136 of the cooling chamber and enter the collision cell 40.

Ions having the mass-to-charge ratio of m1 are selected by the second mass analyzer 50 from the pulsed ions ejected by the opening operations B1 and C1 of the exit electrode 46 and output as pulsed ions D1 and E1, respectively, from the analog signal processing circuitry 80. Signals indicative of the pulsed ions D1 and E1 are sampled by the A/D converter 90 and accumulated by the digital signal processing circuitry 100. The resulting signal is routed to the personal computer 120.

In the same way as in the first embodiment, the opening time tb1 of the exit electrode 46 of the collision cell 40 is made variable, and the opening time tc1 is constant and long enough to eject all the ions in the collision cell 40. All the ions in the collision cell 40 are ejected by the opening operations B1 and C1.

The relation of the ion intensities of the pulsed ions D1 and E1 to the opening time tb1 of the exit electrode 46 is shown in FIG. 4. If the opening time tb1 is long, the ion intensity of the pulsed ion D1 saturates at a certain value S, while the ion intensity of the pulsed ion E1 is null. The time in which the pulsed ion D1 becomes saturated is equal to the opening time tb1 in which the ion intensity of the pulsed ion E1 decreases down to 0.

To make constant the amount of ions fragmented into ions having the mass-to-charge ratio m1 in the collision cell 40, the amount of ions entering the collision cell 40 and the fragmentation efficiency at which precursor ions fragment into ions having the mass-to-charge ratio m1 in the collision cell 40 are made constant. Since the amount of ions entering the collision cell 40 is in proportion to the opening time ta1 of the exit electrode 134 of the cooling chamber 130, the opening time ta1 is kept constant. To make the fragmentation efficiency constant, the amount of gas introduced into the collision cell 40 and the time td1 from the instant when the opening operation A1 of the exit electrode 134 of the cooling chamber 130 starts to the instant when the opening operation B1 of the exit electrode 46 of the collision cell 40 starts are made constant.

Even when the opening time tb1 of the exit electrode 46 of the collision cell 40 is varied, the time td1 is preferably kept constant.

In the same way as in the first embodiment, the personal computer 120 calculates the ratio R (tn) of the intensity of ejected ions for various values of the opening time tn using Eq. (1). The value of the opening time at which the desired ratio of the intensity of ejected ions set by the user is achieved optimally is found. In the adjustment mode, the personal computer 120 optimizes the opening time of the exit electrode 46 of the collision cell 40 for ions having plural mass-to-charge ratios selected by the second mass analyzer 50 using reference samples and creates a data table having corresponding relationship between the mass-to-charge ratio of ions selected by the second mass analyzer 50 and the optimum opening time of the exit electrode 46 by interpolating or extrapolating the obtained results. The table is constructed by and stored in the personal computer 120 and may be referred to according to the need during measurements of actual samples.

Instead of the personal computer 120, the digital signal processing circuitry 100 may search for and find an opening time in which the desired ratio of the intensity of ejected ions is achieved optimally. Then, the data table may be created and stored.

Figure 11:
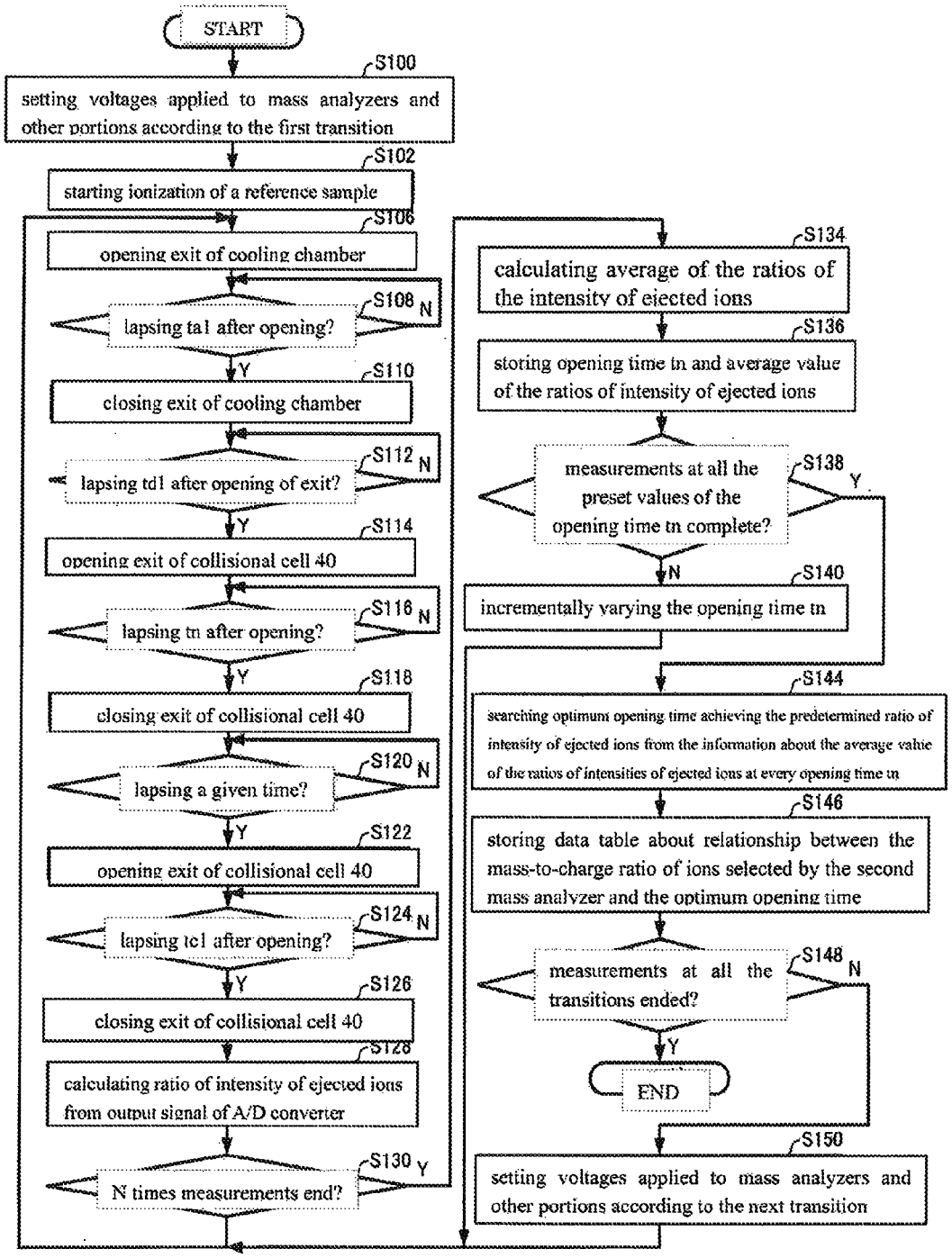
FIG. 11 is a flowchart illustrating one subroutine performed under control of a control section included in the mass spectrometer shown in FIG. 9 in the adjustment mode.

FIG. 11 is a flowchart illustrating one example of processing performed by the control section 200 in the adjustment mode to achieve the operations described so far.

Referring to FIG. 11, the control section 200 performs steps S100 and S102 which are the same as steps S100 and S102, respectively, of FIG. 7 and so a description thereof is omitted.

The control section 200 (especially, the power supply control section 110) then varies the voltage on the exit electrode 136 to open the exit of the cooling chamber 130 (S106).

The control section 200 (especially, the power supply control section 110) then varies the voltage on the exit electrode 136 after a lapse of time ta1 after opening of the exit of the cooling chamber 130 (Yes at S108), thus closing the exit of the cooling chamber 130 (S110).

The control section 200 (especially, the power supply control section 110) then varies the voltage on the exit electrode 46 after a lapse of time td1 since the opening of the exit of the cooling chamber 130 (Yes at S112) to open the exit of the collision cell 40 (S114).

The control section 200 (especially, the power supply control section 110) then varies the voltage on the exit electrode 46 after a lapse of time tn since the opening of the exit of the collision cell 40 (Yes at S116) to close the exit of the collision cell 40 (S118).

The control section 200 then performs steps S120-S128 which are the same as the steps S120-S128, respectively, of FIG. 7 and so a description thereof is omitted.

The control section 200 repeats the steps S106-S128 unless predetermined N (e.g., 10) measurements are complete (No at S130).

When the N measurements end (Yes at S130), the control section 200 performs steps S134 and S136 which are the same as the steps S134 and S136, respectively, of FIG. 7 and so a description thereof is omitted.

The control section 200 varies the opening time tn to the next set value if measurements at all the predetermined values of the opening time tn are not complete (No at S138) (S140). The steps S106-S136 are repeated.

When measurements at all the predetermined values of the opening time tn end (Yes at S138), the control section 200 performs steps S144 and S146 which are the same as the steps S144 and S146, respectively, of FIG. 7 and so a description thereof is omitted.

If measurements at all the transitions set by the user end (Yes at S148), the control section 200 terminates the adjustment mode.

On the other hand, if the measurements at all the transitions do not end (No at S148), the control section 200 sets the voltages on the first mass analyzer 30, second mass analyzer 50, and other portions (S150) according to the next transition, and repeats the steps S106-S146.

(4) Operation in Measurement Mode

The operation of the mass spectrometer 1 according to the second embodiment in the measurement mode is next described. In the following description, it is assumed that ions generated in the ion source 10 are positive ions. The ions may also be negative ions. The principle described below can also be applied to negative ions if the voltages are reversed in polarity.

Figure 12:
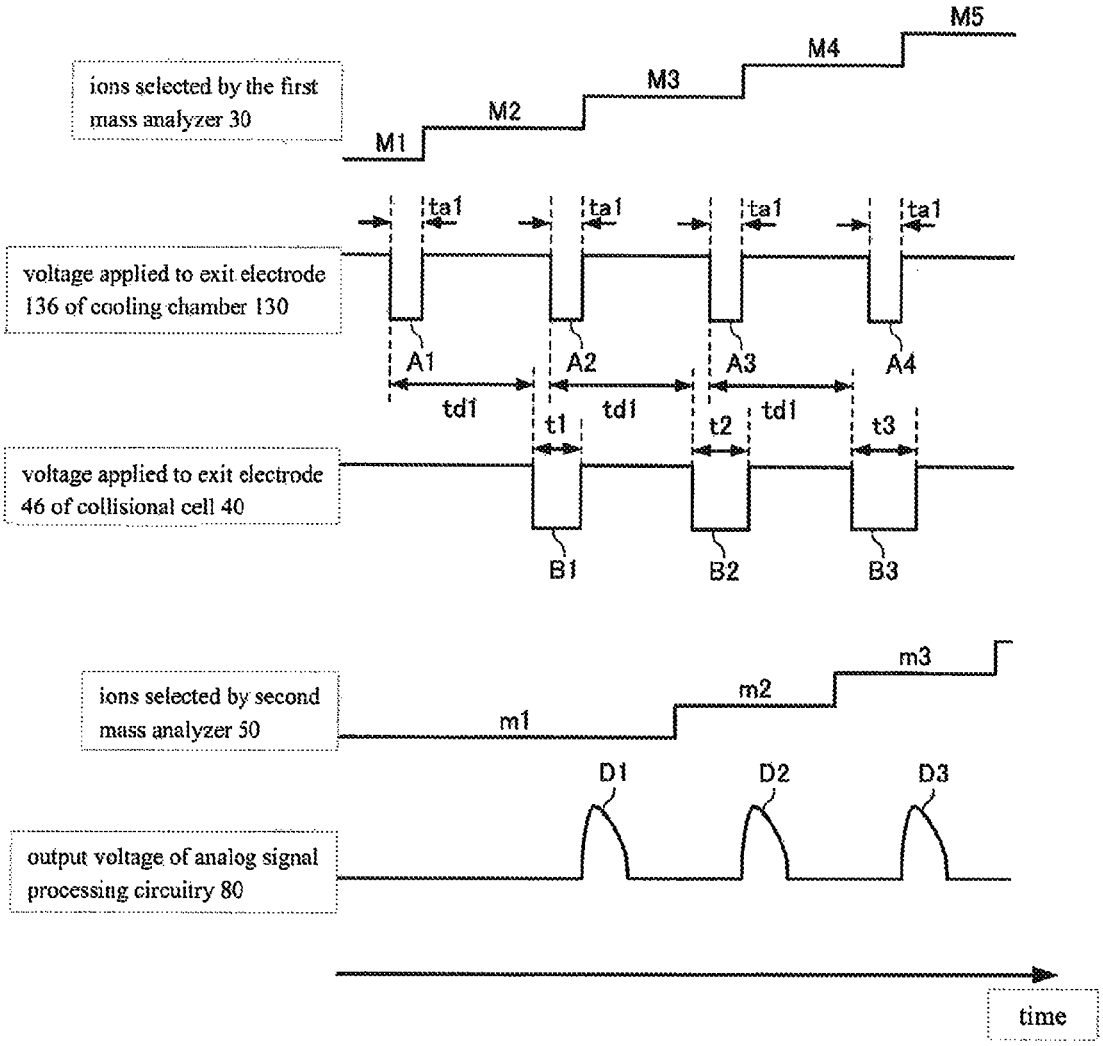
FIG. 12 is a timing chart illustrating operations of the mass spectrometer shown in FIG. 9 in a measurement mode.

FIG. 12 is a timing chart of the voltages applied to the exit electrode 136 of the cooling chamber 130 and to the exit electrode 46 of the collision cell 40 in the measurement mode.

As shown in FIG. 12, a pulsed voltage is applied to the exit electrode 136 of the cooling chamber 130 to set the opening time to ta1 under the condition where the mass-to-charge ratio of ions selected by the first mass analyzer 30 is set to M1. The ions having the mass-to-charge ratio M1 are pulsed, pass through the first mass analyzer 30, and are guided into the collision cell 40.

Ions having the mass-to-charge ratio M1 enter the collision cell 40 after being pulsed by the opening operation A1 of the exit electrode 136 of the cooling chamber 130. These ions fragment in the collision cell 40 and then are ejected by the opening operation B1 of the exit electrode 46. The time t1 of the opening operation B1 is so set that the ratio of the intensity of ejected ions having the mass-to-charge ratio m1 selected by the second mass analyzer 50 becomes equal to the ratio of the intensity of ejected ions set in the adjustment mode, using the table created and stored in the adjustment mode. The table stores information indicating the corresponding relationship between the mass-to-charge ratio of ions selected by the second mass analyzer 50 and the optimum opening time of the exit electrode 46.

Ions having the mass-to-charge ratio m1 are selected by the second mass analyzer 50 from the pulsed ions ejected by the opening operation B1 of the exit electrode 46 of the collision cell 40. As a result, a pulsed ion D1 is produced from the analog signal processing circuitry 80. The signal indicative of the pulsed ion D1 is sampled by the A/D converter 90 and processed by the digital signal processing circuitry 100. The resulting signal is routed to the personal computer 120.

Then, the mass-to-charge ratio of ions selected by the first mass analyzer 30 is varied to M2, for example. A pulsed voltage is applied to the exit electrode 136 of the cooling chamber 130 to set the opening time to ta1. As a result, ions having the mass-to-charge ratio M2 are pulsed and guided into the collision cell 40.

Ions having the mass-to-charge ratio M2 and entering the collision cell 40 after being pulsed by the opening operation A2 of the exit electrode 136 of the cooling chamber 130 fragment in the collision cell 40 and then are ejected by the opening operation B2 of the exit electrode 46. The period of time t2 of the opening operation B2 is set such that the ratio of the intensity of ejected ions having the mass-to-charge ratio m2 of ions selected by the second mass analyzer 50 becomes equal to the ratio of the intensity of ejected ions set in the adjustment mode, using the table created and stored in the adjustment mode.

Ions having the mass-to-charge ratio m2 are selected by the second mass analyzer 50 from pulsed ions ejected by the opening operation B2 of the exit electrode 46 of the collision cell 40. As a result, a pulsed ion D2 is produced from the analog signal processing circuitry 80. A signal indicative of the pulsed ion D2 is sampled by the A/D converter 90 and processed by the digital signal processing circuitry 100. Then, the resulting signal is routed to the personal computer 120.

The mass-to-charge ratio of ions selected by the first mass analyzer 30 is then varied to M3, for example. If a pulsed voltage is applied to the exit electrode 136 of the cooling chamber 130 to set the opening time to ta1, ions having a mass-to-charge ratio of M3 are pulsed and introduced into the collision cell 40.

The ions having the mass-to-charge ratio M3 and entering the collision cell 40 after being pulsed by the opening operation A3 of the exit electrode 136 of the cooling chamber 130 fragment in the cell 40 and then are ejected by the opening operation B3 of the exit electrode 46. The period of time t3 of the opening operation B3 is set such that the ratio of the intensity of ejected ions having the mass-to-charge ratio m3 selected by the second mass analyzer 50 becomes equal to the ratio of the intensity of ejected ions set in the adjustment mode, using the table created and stored in the adjustment mode.

Ions having the mass-to-charge ratio m3 are selected by the second mass analyzer 50 from the pulsed ions ejected by the opening operation B3 of the exit electrode 46 of the collision cell 40. As a result, a pulsed ion D3 is output from the analog signal processing circuitry 80. A signal indicative of the pulsed ion D3 is sampled by the A/D converter 90 and processed by the digital signal processing circuitry 100. The resulting signal is routed to the personal computer 120.

In this way, in the measurement mode, whenever the transition is varied, the opening time of the exit electrode 46 of the collision cell 40 is automatically set to an optimum value such that the ratio of the intensity of ejected ions selected by the second mass analyzer 50 becomes equal to a desired value, using a table previously created in the adjustment mode.

According to the mass spectrometer according to the second embodiment described so far, the opening time of the exit electrode 46 of the collision cell 40 is optimized in the measurement mode by searching for and finding a value of the opening time of the exit electrode 46 at which a desired ratio of intensity of desired ions is achieved optimally in the same way as in the first embodiment. As a consequence, the fastest multiple reaction monitoring (MRM) within the tolerable range of interference between transitions permitted by the user or operator is enabled.

Furthermore, according to the mass spectrometer of the second embodiment, a data table indicating the relationship of the optimum opening time of the exit electrode 46 of the collision cell 40 to mass-to-charge ratios of ions selected by the second mass analyzer 50 in the adjustment mode is created, in the same way as in the first embodiment. Therefore, during measurements of actual samples in the measurement mode, the opening time of the exit electrode 46 can be optimized for each transition.

In the first embodiment, when the entrance electrode 44 of the collision cell 40 is closed, ions are lost. In contrast, in the mass spectrometer according to the second embodiment, even if the exit electrode 136 of the cooling chamber 130 is closed, ions are not lost but stored in the cooling chamber 130. Consequently, pulsed ions can be measured at higher sensitivity than in the first embodiment. Furthermore, the opening time can be adjusted accurately. The method of adjusting the mass spectrometer according to the second embodiment is effective where the opening time of the existing quadrupole mass spectrometer equipped with a cooling chamber is adjusted.

In the present embodiment, the voltage applied to the exit electrode 136 of the cooling chamber 130 and the voltage applied to the exit electrode 46 of the collision cell 40 are pulsed voltages. These voltages can be in any form of controlled voltage as long as they temporarily cut off the flow of the ions and permit the flow only in a predetermined time.

The desired ratio of the intensity of ejected ions may be entered by the user or operator based on the tolerable range of interference between transitions. Alternatively, the desired ratio may be previously stored in the memory of the personal computer 120.

3. Modifications

It is to be noted that the present invention is not restricted to the embodiments described so far. Rather, the embodiments can be modified variously within the scope of the present invention.

Modification 1

In the above-described embodiments, the control section 200 searches for and finds the opening time of the exit electrode 46 of the collision cell 40 in which the ratio of the intensity of ejected ions selected by the second mass analyzer 50 in the adjustment mode assumes a desired value. Instead of the ratio of the intensity of the ejected ions, the control section may search for and find the opening time of the exit electrode 46 in which the intensity of ejected ions selected by the second mass analyzer 50 assumes a desired value.

Specifically, in the present modification, the control section 200 searches for and finds the optimum opening time of the exit electrode 46 in which the ion intensity of the pulsed ions D1 shown in FIG. 3 assumes a desired value for each mass-to-charge ratio of ions selected by the second mass analyzer 50 in the adjustment mode and creates a data table storing information about the corresponding relationship between the mass-to-charge ratio of ions selected by the second mass analyzer 50 and the optimum opening time of the exit electrode 46. In the measurement mode, the control section 200 automatically sets the opening time of the exit electrode 46 in which the intensity of ejected ions converted into a reference sample assumes a desired value for each transition, using the table created in the adjustment mode.

The flowchart of FIG. 2 may be modified to set the intensity of ions ejected from the collision cell 40 instead of setting the ratio of the intensity of ions ejected from the collision cell 40 in step S10. The modified flowchart is adapted for the method of adjusting the mass spectrometer 1 of the present modification for adjusting the opening time of the collision cell 40 in the adjustment mode.

The flowchart of FIG. 7 or FIG. 11 illustrating the processing performed by the control section 200 according to the present modification in the adjustment mode may be modified to set the intensity of ions ejected from the collision cell 40 instead of computing, storing, or using the ratio of the intensity of ions ejected from the collision cell 40 at steps S128, S134, S136, and S144.

Modification 2

In the above embodiments, in the adjustment mode, transitions of used reference samples are selected by the first mass analyzer 30 and the second mass analyzer 50. At least one of the first mass analyzer 30 and the second mass analyzer 50 may be modified to act as an ion guide that passes all ions having a desired mass-to-charge ratio or higher.

In the mass spectrometer according to the present modification, in the adjustment mode, at least one of the first mass analyzer 30 and the second mass analyzer 50 is operated as an ion guide. This increases the amount of ions passing through the first mass analyzer 30 and the second mass analyzer 50. Consequently, higher-sensitivity measurements are enabled. As a result, the number of measurements can be reduced and thus the adjustment time can be shortened. Especially, if only the first mass analyzer 30 is operated as an ion guide, a data table storing information indicating the corresponding relationship between the mass-to-charge ratio of ions selected by the second mass analyzer 50 and the optimum opening time of the exit electrode 46 in the adjustment mode can be constructed. Also, high-sensitivity measurements can be performed. The transition set in the adjustment mode at this time specifies only the mass-to-charge ratio of ions selected by the second mass analyzer 50.

It is to be noted that the above-described embodiments and modifications are merely exemplary and that the present invention is not restricted thereby. For instance, the embodiments and modifications may be appropriately combined.

The present invention embraces configurations (e.g., configurations identical in function, method, and results or identical in purpose and advantageous effects) which are substantially identical to the configurations described in any one of the above embodiments. Furthermore, the invention embraces configurations which are similar to the configurations described in any one of the above embodiments except that their nonessential portions have been replaced. Additionally, the invention embraces configurations which are identical in advantageous effects to, or which can achieve the same object as, the configurations described in any one of the above embodiments. Further, the invention embraces configurations which are similar to the configurations described in any one of the above embodiments except that a well-known technique is added.

Having thus described my invention with the detail and particularity required by the Patent Laws, what is desired protected by Letters Patent is set forth in the following claims.

The invention claimed is:

1. A mass spectrometer comprising:

an ion source for ionizing a sample;

a first mass analyzer for selecting first desired ions from the ions generated in the ion source according to mass-to-charge ratio;

a collision cell for fragmenting some or all of the first desired ions into product ions having electrodes controlling entrance and exit to and from said cell;

a second mass analyzer for selecting second desired ions from the first desired ions and the product ions according to mass-to-charge ratio;

a detector for detecting the second desired ions; and a control section having a computer programmed for controlling the entrance and exit electrodes of the collision cell, said control section programmed for storing a target value of a ratio of the amount of the second desired ions ejected from the collision cell by an opening operation to the amount of the second desired ions stored in the collision cell immediately prior to the opening operation permitting a tolerable range of interference between transitions performed in succession, said control section programmed to control the entrance and exit electrodes to provide a measurement mode such that the collision cell performs a storing operation for storing the first desired ions and the product ions for a given storage time and then performs the opening operation for ejecting the stored ions for a given opening time consistent with said target value, said control section programmed to provide an adjustment mode by varying the opening time to adjust the given opening time for ejecting stored ions to be consistent with said target value of the ratio of ejected second ions to stored second desired ions.

2. The mass spectrometer as set forth in claim 1, wherein said control section causes the collision cell to perform said storing operation by opening an entrance electrode of the collision cell and closing an exit electrode of the collision cell and causes the collision cell to perform the opening operation by closing the entrance electrode of the collision cell and opening the exit electrode of the collision cell.

3. The mass spectrometer as set forth in claim 1, wherein said control section, in said adjustment mode being programmed to cause the collision cell to perform the opening operation plural times whenever said storing operation is performed once, being programmed to measure the amount of the second desired ions ejected from the collision cell by the opening operation performed first in response to a detection signal from said detector while varying the opening time during the opening operation performed first after said storing operation and the amount of the second desired ions ejected from the collision cell by performing the opening operation plural times, and being programmed to calculate a value of the opening time at which the ratio of these two measured amounts is closest to said target value.

4. The mass spectrometer as set forth in claim 1, wherein said control section, in said adjustment mode, measures the amount of the second desired ions ejected from the collision cell by the opening operation in response to the detection signal from said detector while varying the opening time and calculates a value of said opening time at which the measured amount is closest to said target value.

5. The mass spectrometer as set forth in claim 1, wherein said control section provides control to maintain said storage time constant.

6. The mass spectrometer as set forth in claim 1, wherein said control section provides control such that at least one of said first mass analyzer and said second mass analyzer operates as an ion guide.

7. The mass spectrometer as set forth in claim 1, further comprising a cooling chamber mounted between the ion source and said first mass analyzer to lower kinetic energies of the ions generated in the ion source, and wherein said control section provides control such that the cooling chamber performs a storing operation for temporarily storing the ions generated in the ion source and then performs an opening operation for ejecting the stored ions.

8. The mass spectrometer as set forth in claim 7, wherein said control section causes the cooling chamber to perform said storing operation by keeping the entrance of the cooling chamber open and closing the exit of the cooling chamber and causes the cooling chamber to perform the opening operation by opening the exit of the cooling chamber.

9. The mass spectrometer as set forth in claim 7, wherein said control section provides control such that said storing operation and the opening operation are carried out for given times by the cooling chamber.

10. The mass spectrometer as set forth in claim 1, wherein said control section, in said adjustment mode, calculates the opening time according to the mass-to-charge ratio of the second desired ions, produces information indicating corresponding relationships between the mass-to-charge ratios of the second desired ions and set values of the opening time based on the calculated opening times, and records the produced information.

11. The mass spectrometer as set forth in claim 10, wherein said control section, in a measurement mode, sets the opening time according to the mass-to-charge ratios of the selected second desired ions based on said information about the corresponding relationships.

12. The mass spectrometer as set forth in claim 1, wherein at least one of said first mass analyzer and said second mass analyzer includes a quadrupole mass filter.

13. A method of adjusting a mass spectrometer having: an ion source for ionizing a sample; a first mass analyzer for selecting first desired ions from the ions generated in the ion source according to mass-to-charge ratio; a collision cell for fragmenting some or all of the first desired ions into product ions; a second mass analyzer for selecting second desired ions from the first desired ions and the product ions according to mass-to-charge ratio; a detector for detecting the second desired ions; and a control section for controlling the collision cell in such a way that the cell performs a storing operation for storing the first desired ions and the product ions for a given storage time and then performs an opening operation for ejecting the stored ions for a given opening time, said method comprising the steps of:

performing a first measuring step for measuring the amount of the second desired ions ejected from the collision cell by the opening operation while varying the opening time;

performing a second measuring step for measuring the amount of the second desired ions stored in the collision cell immediately prior to the opening operation of said first measuring step;

calculating an ejected ion intensity ratio that is defined to be the ratio of the amount measured by the first measuring step to the amount measured by the second measuring step during each said opening time for ejecting stored ions; and calculating a value of the opening time for ejecting stored ions at which the ejected ion intensity ratio is closest to a target value of the ratio of ejected second ions to stored second desired ions permitting a tolerable range of interference between transitions performed in succession, based on the calculated ejected ion intensity ratio.

14. A method of adjusting a mass spectrometer having: an ion source for ionizing a sample; a first mass analyzer for selecting first desired ions from the ions generated in the ion source according to mass-to-charge ratio; a collision cell for fragmenting some or all of the first desired ions into product ions; a second mass analyzer for selecting second desired ions from the first desired ions and the product ions according to mass-to-charge ratio; a detector for detecting the second desired ions; and a control section for controlling the collision cell in such a way that the cell performs a storing operation for storing the first desired ions and the product ions for a given storage time and then performs an opening operation for ejecting the stored ions for a given opening time, said method comprising the steps of:

measuring the amount of the second desired ions ejected from the collision cell by the opening operation while varying the opening time; and calculating a value of the opening time for ejecting stored ions at which the amount of the second desired ions ejected from the collision cell by the opening operation is closest to a target value of the ratio of ejected second ions to stored second desired ions permitting a tolerable range of interference between transitions performed in succession, based on the measured amount of the second desired ions.

* * * * *